United States Patent [19]

Burke et al.

[11] Patent Number: 4,794,235

[45] Date of Patent: Dec. 27, 1988

[54] NON-LINEAR PREDICTION FOR GUN FIRE CONTROL SYSTEMS

[75] Inventors: Harold H. Burke; Toney R. Perkins, both of Bel Air, Md.

[73] Assignee: The United States of America as represented by the Secretary of the Army, Washington, D.C.

[21] Appl. No.: 864,400

[22] Filed: May 19, 1986

[51] Int. Cl.[4] ..... G06G 7/80

[52] U.S. Cl. ..... 235/412; 364/423

[58] Field of Search ..... 89/41.01, 41.02, 41.07; 364/423; 235/411, 412

[56] References Cited

U.S. PATENT DOCUMENTS

| | | | |
|---|---|---|---|
| 2,949,824 | 8/1960 | Abt | 89/41.02 |
| 2,995,296 | 7/1961 | Newell | 235/412 |
| 3,176,292 | 3/1946 | Harris | 235/412 X |
| 4,004,729 | 1/1977 | Rawicz | 89/41.07 |
| 4,146,780 | 3/1979 | Sprey | 364/423 X |
| 4,179,696 | 12/1979 | Quesinberry | 235/412 X |
| 4,402,250 | 9/1983 | Baasch | 364/423 X |
| 4,402,251 | 9/1983 | Burke | 89/41.01 |
| 4,590,476 | 5/1986 | Burkett | 342/422 X |

OTHER PUBLICATIONS

Russell Berg, "Estimation and Prediction for Maneuvering Target Trajectories", 1983 IEEE.

Michael Griswold, "AFT1/F-16 Automated Maneuvering Attack System", 1986 IEEE.

James Leathrum, "An Approach to Fire Control System Computations and Simulations", Apr. 1975, AMSAA Tech Report 126, US Army Aberdeen.

George Burgin, "An Adaptive Maneuvering Logic Computer Program for the Simulation of One-On-One Air-to-Air Combat-vol. II", Sep. 1975, NASA CR-2583.

James Leathrum, "On the Design of Predictors for Fire Control Systems" Nov. 1981, AMSAA Tech Report 348.

Robert Scheder, "Adaptive Estimation", Dec. 1976, AMSAA Tech Report 166.

*Primary Examiner*—Jerry Smith

*Assistant Examiner*—Steven G. Kibby

*Attorney, Agent, or Firm*—Saul Elbaum; Thomas E. McDonald; Edward Stolarun

[57] ABSTRACT

An improved method and apparatus for aiming a gun at a target moving along a non-linear path is disclosed which relies upon the discovery that at any given moment in a non-linear path, a target is traversing an arc of a circle. Methods for calculating offsets for aiming a gun at a point further along on the arc of the circle in accordance with the determined time of flight of the projectile are disclosed.

1 Claim, 5 Drawing Sheets

V = VEHICLE SPEED
a = TURNING RADIUS
θ = ANGLE FROM REFERENCE
ω = ANGULAR RATE
$\frac{V^2}{a}$ SIN θ = APPARENT ACCELERATION
$\frac{V}{a}$ COS θ = APPARENT RATE
ΔT = Δθ/ω

NON-LINEAR PREDICTION FOR GUN FIRE CONTROL SYSTEMS

RIGHTS OF THE GOVERNMENT

The invention described herein may be used by the United States Government for governmental purposes without the payment to the inventors of any royalty thereon.

FIELD OF THE INVENTION

This invention relates to improved fire control systems. More particularly, this invention relates to an improved fire control system in which accurate fire control compensation is made for non-linear movements in target position, for example, due to maneuvering target vehicles.

BACKGROUND AND OBJECTS OF THE INVENTION

There are available fire control systems which are capable of tracking a moving target and outputting a set of signals indicative of the target's instantaneous position and velocity. These signals are used in fire control systems to provide lead to the aiming of a gun that fire projectiles. The assumption made in such fire control systems is that the motion of the target at any given moment is linear, such that the required lead is a linear function of the target's instantaneous velocity and the computed time of flight of the projectile. An example of this type of fire control system is described in U.S. Pat. No. 4,004,729, issued Jan. 25, 1977 to Rawicz et al.

Estimated roll angles and load factors of a maneuvering target aircraft may be manually inputted into a fire control computer of the fire control system described in U.S. Pat. No. 4,146,780, issued Mar. 27, 1979 to Sprey. In response to other signals received from conventional target tracking and ranging devices, the computer first calculates linearly projected future positions of the target aircraft. Corrections, which may be curvilinear, to these projected positions are then calculated from the inputed estimates of aircraft roll angle and load factor. An operator can selectively actuate manual controls to cause the fire control computer to combine this correction with the linearly calculated future positions. Control signals corresponding to these new intercept positions are transmitted to conventional gun laying equipment to cause the gun to be aimed at the intercept positions.

In the radar tracking system described in U.S. Pat. No. 4,179,696, issued Dec. 18, 1979 to Quesinberry et al, a nine state Kalman filter is provided with angle and range track error measurements in a coordinate system that is aligned with and normal to the antenna line of sight (LOS coordinate system). The Kalman filter converts these measurements to predict target position referenced to a stable coordinate system.

In their previous U.S. Pat. No. 4,402,251, the applicants disclose a fire control system in which the apparent area of the maneuvering target is monitored in order to generate a gun line offset (i.e. an offset from the line of sight between the gun and the target, to compensate for the motion of the target, equivalent to lead) which is a function of the target velocity and acceleration. When the line of sight angular rate crosses through zero, (minimum apparent area) a firing command is initiated. This system is not without utility, in particular for a class of targets where the product of target velocity and projectile time of flight is much less than the engagement range. However, the inventors have now realized that further improvements can additionally be made.

Accordingly, it is an object of the invention to provide an improved fire control system useful in generating continuous gun line offsets from the line of sight to the target so as to improve the aim of a gun engaging a maneuvering target.

All common land, sea and air vehicles are elongated in the direction of their travel and they travel along straight lines unless an acceleration having at least a component perpendicular to the direction of travel is experienced. In a land vehicle lateral acceleration is provided by turning a wheel with respect to the direction of travel. In an airplane, lateral acceleration is provided by a control surface; similarly in the case of a ship. In each case, note that the acceleration must have a component perpendicular to the direction of travel if a turn is to be effected.

Basic physics teaches that the motion of an object subjected to an constant acceleration perpendicular to its velocity is an arc of a circle if the magnitude of the velocity (speed) is constant. Accordingly, the applicants have realized that if one can determine the instantaneous velocity and perpendicular acceleration of a target, one can then calculate the arc of the circle defined thereby, and can adjust the gun line offset accordingly.

It is an object of the invention to provide an improved gun line offset system, which comprises means for predicting the nonlinear lead (offset) when engaging a maneuvering target, so that the projectile will intersect the target a projectile time of flight later.

It is the ultimate object of the invention to provide an improved fire control system which allows maneuvering targets to be hit with increased frequency.

SUMMARY OF THE INVENTION

The present invention satisfies the needs of the art and the objects of the invention listed above by its provision of an improved fire control system in which a maneuvering target is tracked to determine its instantaneous velocity V and acceleration A. From these, a value for angular velocity $\omega$ can be derived. The assumption is made that the vehicle is traversing an arc of a circle. Therefore, the arc of the circle can be used to calculate gun line offsets, $\Delta X$ and $\Delta Y$, using the relationships $\Delta Y = -a + a \cos \omega t_f$ and $\Delta X = a \sin \omega t_f$, where a is the radius of the circle, and $t_f$ is the time of flight of the projectile. These expressions are modified for target motion along non-circular arcs.

In the preferred embodiment, the Taylor series expansion of the sine and cosine terms is used to provide a reasonable approximation of the sine and cosine functions within a minimum amount of computation time.

BRIEF DESCRIPTION OF THE DRAWINGS

The invention will be better understood if reference is made to the accompanying drawings, in which.

DESCRIPTION OF THE PREFERRED EMBODIMENTS

As discussed above, the prior art has generally provided automatic gun aiming by adding offsets to a line of sight aimed at the target at a given time, the offsets being determined on the assumption that the target is proceeding along a straight line at a constant velocity. Needless to say, this is frequently not the case. In fact, in many instances, target vehicles are purposely maneuvered to take anything but a straight line path, for obvious reasons. In order to provide an improved device for generating appropriate offsets, it is necessary to make certain assumptions about the future motion of the target. Clearly, no matter what assumptions are made some targets will inevitably be missed because there is no guarantee that the target will not change its maneuvering pattern during the time of flight of the projectile.

The present inventors have realized that it is possible to improve the accuracy by their realization that all targets do not travel along a straight line. The motion of a vehicle experiencing an acceleration at a right angle to its direction of travel is an arc of a circle. Accordingly, at any given time, any maneuvering target (i.e., one which is being accelerated perpendicular to its instantaneous straight line path) is describing an arc of a circle. If the arc of the circle is correctly calculated and if the target continues to experience that same acceleration during the time of flight of a particular projectile, it is possible to cause the projectile to strike the target with substantially improved accuracy. The present invention thus includes the realization that the paths of maneuvering targets comprise connected segments of arcs, and includes methods and apparatus for exploiting this discovery.

Figure 1:
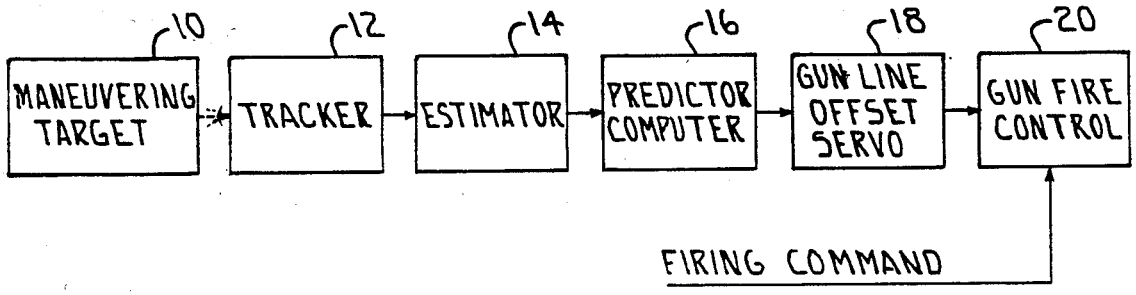
FIG. 1 shows an overall view of the system of the invention.

The major components of this system are illustrated in FIG. 1. Maneuvering target 10 is tracked by a conventional tracker 12. For example, the tracker 12 can be a radar system similar to that described in the above-referenced U.S. Pat. No. 4,179,696 to Quesinberry et al, incorporated herein by reference, which generates signals that represent range, radial velocity, and the elevation and azimuth angles to the target. Signals from the tracker 12 are supplied to an estimator 14 which outputs signals indicative of the target's instantaneous position, velocity and acceleration. For example, the estimator 14 can be a Kalman filter similar to that described in the above-referenced Quesinberry et al Patent. These signals are then supplied to a predictor computer 16 which operates in a manner described in detail below to generate gun line offset signals. These are supplied to a gun line offset servo 18 which adjusts the aim of the gun (not shown). When a firing command is given to a gun fire control 20, the gun is then fired accordingly.

Figure 2:
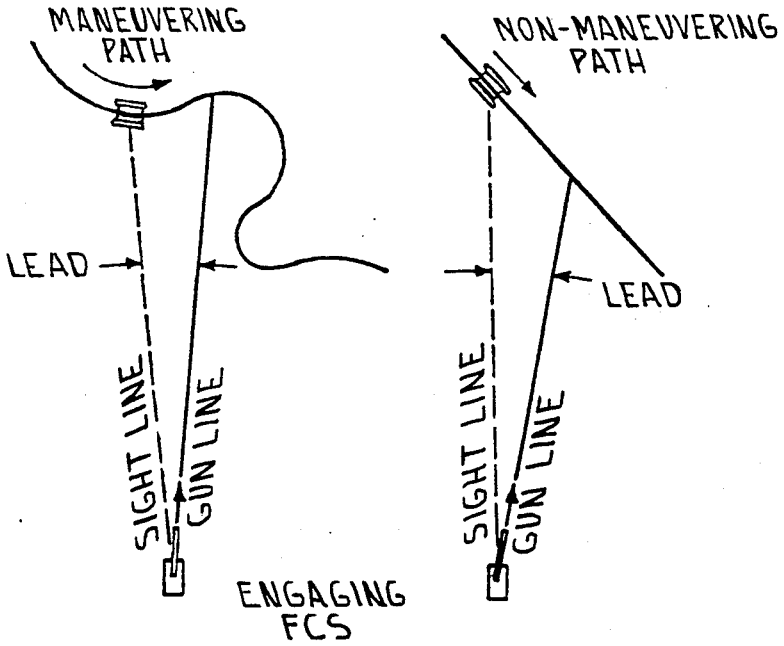
FIG. 2 shows broadly the function of the fire control system according to the invention.

FIG. 2 shows the basic problem faced by fire control systems (FCS) engaging a maneuvering and non-maneuvering target, on the left and the right sides of the diagram of FIG. 2, respectively. As shown on the right, a non-maneuvering target travels in a straight line and therefore the lead can be calculated as a linear function of the target's velocity and direction. As shown on the left, the lead with respect to the maneuvering target varies very greatly depending on the actual path taken by the target. It is an object of the invention to provide a fire control system which will accurately calculate this lead.

Figure 3:
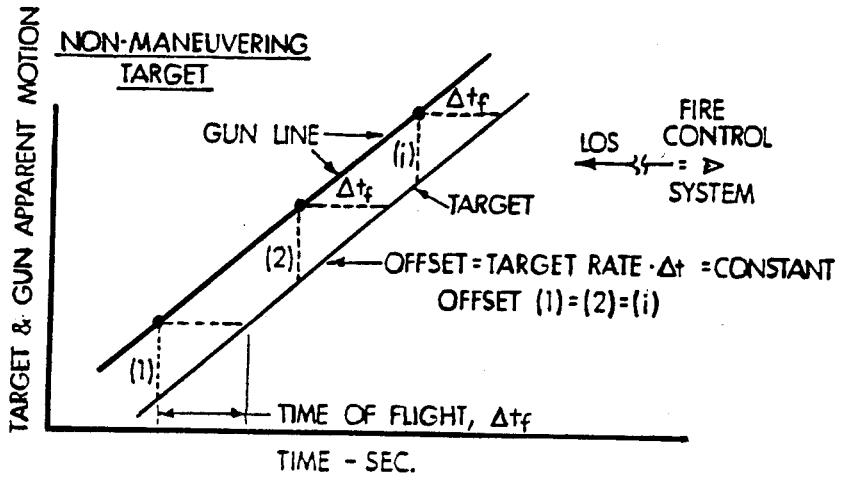
FIG. 3 shows the difference in required fire control offsets for non-maneuvering and maneuvering targets.
Figure 3A:
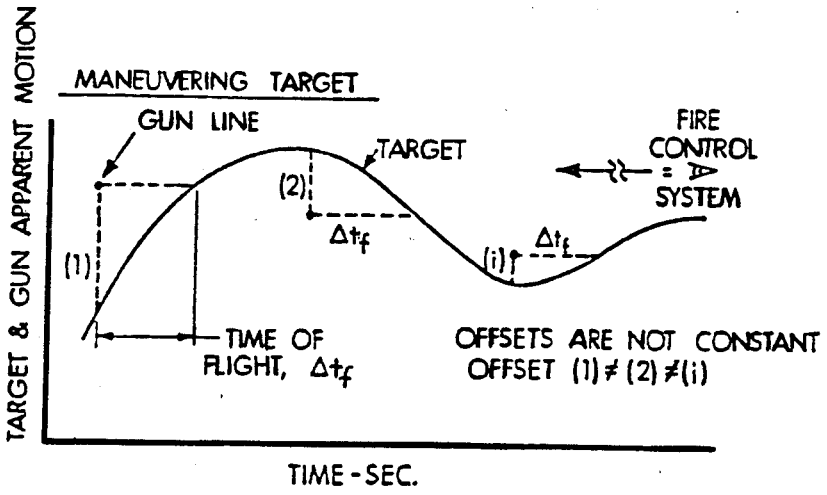

FIG. 3 shows a comparison of offsets between non-maneuvering and maneuvering targets, as shown in FIG. 2. The fire control solution is related to the velocity vector or target rate as shown. The gun line, that is, the line along which the gun is to be pointed, differs from the line along which the target is moving, by an offset equal to the target rate times $t_f$, where $t_f$ is the time of flight. Offsets 1, 2, . . . i are thus constant for linear target motion. By comparison, and as shown in the lower half of FIG. 3, the offset required in connection with a maneuvering target varies with respect to the instantaneous velocity and acceleration of the target; as shown, offsets 1, 2, . . . i are not equal to one another.

Figure 4:
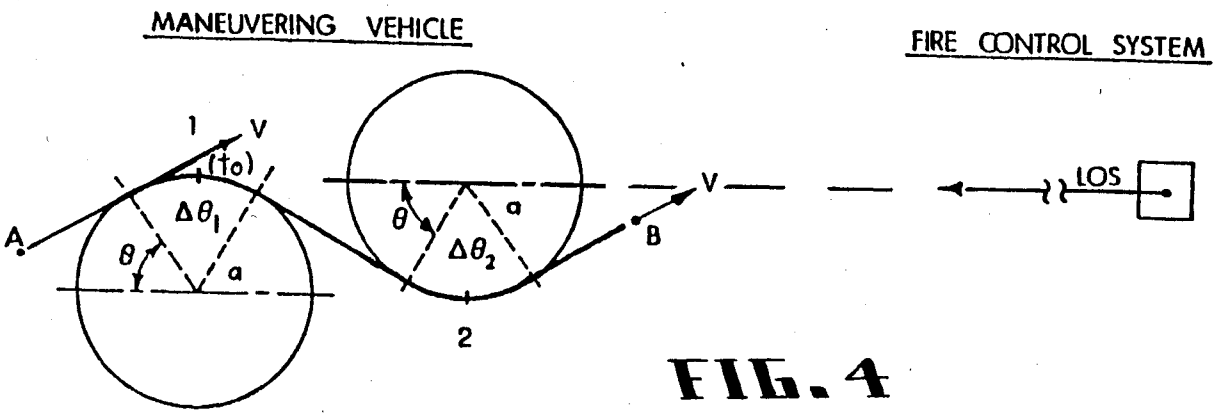
FIG. 4 shows typical intentional maneuvers, describes some of the terminology used herein and shows apparent vehicle movement.
Figure 4A:
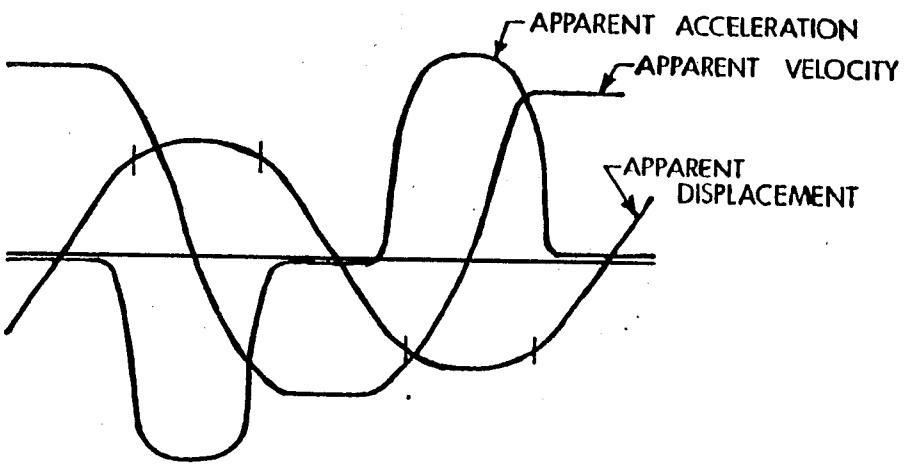
Figure 4A:
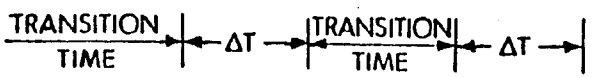

FIG. 4 shows certain diagrams useful in understanding the principles of the invention. On the upper portion of FIG. 4, a maneuvering vehicle's path is shown extending from A to B. As shown, it comprises a number of essentially circular segments joined by straight lines. It will be appreciated by those skilled in the art, of course, that the circular segments will tend to be joined by transitional segments of greater radius, but the applicants have found that by making the assumption that the arcs are generally circular and by constantly updating the information used by the fire control computer 16 (FIG. 1) to calculate the offsets, substantial improvements in accuracy can be realized. The line connecting the fire control system and the center of rotation of the target at any given time is a reference line. An angle $\theta$ is formed by the normal to the path of the target at any given moment and this reference line.

The total change in trajectory with respect to any given arc is $\Delta\theta_i$. The radius of curvature of each arc is a.

The drawing in the lower half of FIG. 4 shows the relationship of the target displacement, its velocity and acceleration. As is well understood, velocity is the time derivative of displacement, and acceleration is the time derivative of velocity. The curves in the lower half of FIG. 4 are accordingly related. The apparent displacement is essentially similar to the path connecting points A and B shown in the upper portion of FIG. 4. Note that it is not a sine curve, but it is indeed two circular arcs joined by straight segments. Accordingly, the apparent velocity curve is not a true cosine curve. Similarly, the apparent acceleration curve approaches zero at a number of points because the velocity is not changing during the straight line segments of the displacement curve.

As also shown in FIG. 4, certain terms are defined. V is equal to vehicle speed; a is equal to its turning radius; $\omega$ is the angular rate, that is to say, the angular velocity; $V^2 \sin \theta/a$ is equal to the apparent acceleration; $V \cos \theta/a$ is equal to the apparent angular rate; and $\Delta T$ is equal to $\Delta\theta/\omega$.

Figure 5:
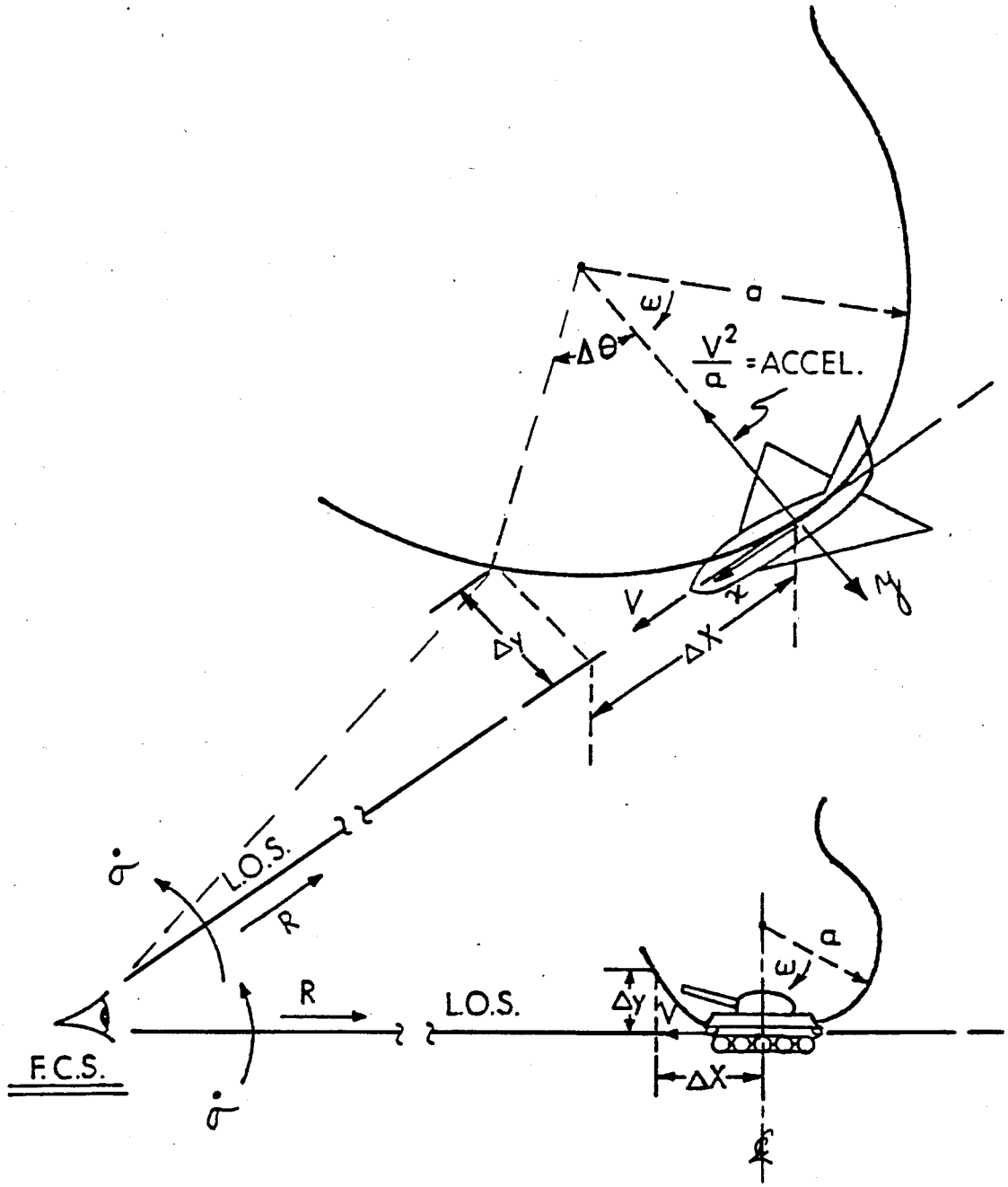
FIG. 5 shows maneuvering target scenarios and defines certain additional terms.

As mentioned, the present inventors have realized that the trajectory of a maneuvering target at any given moment is an arc of a circle. According to the present invention, the characteristics of the circle are determined and used to determine offsets $\Delta Y$ and $\Delta X$, which are corrections added to the line of sight to produce the gun line. FIG. 5 shows how this can be done.

If the circle has radius a, target velocity V and perpendicular acceleration $A_N$ ($=V^2/a$), then the angular velocity $\omega$ of the vehicle is V/a or $A_N/V$. The distance subtended by arc $\Delta\theta$ is $\omega t_f$ where $t_f$ is the projectile time of flight. If an x-y coordinate system is located with its origin at the target, aligning the x-axis along the velocity vector V and the y axis perpendicular thereto, parallel to the acceleration $A_N$, movement during the projectile time of flight can be determined with respect to the target centered x-y axis system as follows.

Target movement along y axis $\Delta y$ is $$\Delta Y = -a + a \cos \omega t_f$$

But $\cos \omega t_f$ can be expressed in a Taylor series as $$\cos\omega t_f = 1 - \frac{(\omega t_f)^2}{2!} + \frac{(\omega t_f)^4}{4!} - \ldots$$

Therefore $$\Delta Y = -a + \left[ a - \frac{a\,(\omega t_f)^2}{2!} + \frac{a\,(\omega t_f)^4}{4!} - \ldots \right]$$

This is sometimes a more useful expression, depending on the actual predictor computer 16 (FIG. 1) selected.

But $a\omega^2$ is the value of acceleration $A_N$, normal to the velocity. Then $$\Delta Y = -\frac{A_N t_f^2}{2}\left[1 - \frac{(\omega t_f)^2}{12}\right],$$

truncating the series after the third term.

Movement along the x axis must also be considered.

$$\Delta x = a \sin \omega t_f$$

But since $\sin \omega t_f$ can be expressed in a Taylor series as $$\sin\omega t_f = t_f - \frac{(\omega t_f)^3}{3!} + \ldots$$

Then $$\Delta x = a\omega t_f\left[1 - \frac{(\omega t_f)^2}{3!} + \ldots\right]$$

But as $a\omega$ is the magnitude of the velocity v, $$\Delta x = V t_f\left[1 - \frac{(\omega t_f)^2}{6}\right],$$

again, truncating the series after its second term.

The above expressions provide a way of predicting $\Delta X$ and $\Delta Y$ in the frame of reference of the target and given an initial time $t_0$. In order to provide useful offset data, of course, these quantities must be put in the frame of reference of the gun location. This can be accomplished as follows.

Figure 6:
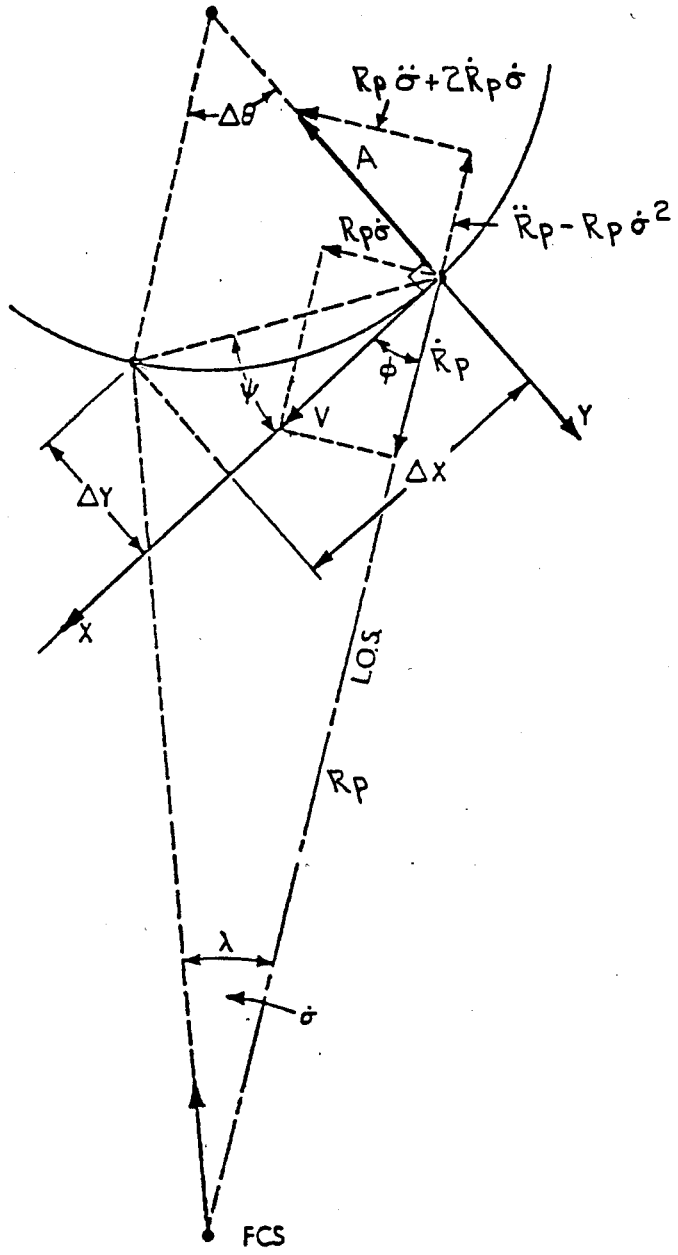
FIG. 6 shows a diagram describing the quantities used in the mathematical description of this invention which is provided herein.

Referring now to FIG. 6, transformation of the offset with respect to the x-y coordinate system, having its origin at the target, to a LOS frame of reference is possible by determining the angle $\phi$, which is equal to $\tan^{-1} R_p\dot{\sigma}/\dot{R}_p$, where $R_p$ = target range, $\dot{R}_p$ = target range velocity, $\ddot{R}_p$ = target range acceleration, $\dot{\sigma}$ = line of sight rate (i.e., angular movement of the target with respect to the FCS), and $\ddot{\sigma}$ = line of sight acceleration.

The target is tracked by a fire control system. As mentioned, the present range is $R_p$, and the motion of the line of sight is $\dot{\sigma}$. The fire control system measures $R_p$ and $\dot{\sigma}$, and estimates $\dot{R}_p$, $\ddot{R}_p$, and $\ddot{\sigma}$. The maneuvering target moves through an arc $\Delta\theta$ during $t_f$, the time of flight of the projectile. The gun line is offset from the LOS to the target by the angle $\lambda$. The geometry of the engagement between the maneuvering target and fire control system is shown in FIG. 6.

The total acceleration of the maneuvering target expressed in LOS terms is $$[(\ddot{R}_p - R_p\dot{\sigma}^2)^2 + (R_p\ddot{\sigma} + 2\dot{R}_p\dot{\sigma})^2]^{\frac{1}{2}}$$

The velocity of the maneuvering target expressed in LOS terms is $$[(R_p\dot{\sigma})^2 + \dot{R}_p^2]^{\frac{1}{2}}$$

The perpendicular acceleration of the maneuvering target in the V-A reference frame is $$A_N = \frac{V^2}{a}$$

Orientation of the maneuvering target velocity relative to the LOS is $$\phi = \tan^{-1}\frac{R_p\dot{\sigma}}{\dot{R}_p}$$

The angular rate of the maneuvering target about its center of curvature is $$\omega = \frac{A_N}{V}$$

The arc of movement of the maneuvering target about its centering of curvature during the time of flight of the projectile is $$\Delta\theta = \omega t_f$$

The displacement of the maneuvering target perpendicular to the orientation of the target velocity at the time the projectile is fired is $$\Delta Y = -\frac{1}{2} A_N t_f^2\left(1 - \frac{\omega^2 t_f^2}{12}\right)$$

Displacement of the maneuvering target parallel to the orientation of the target velocity at the time the projectile is fired is $$\Delta X = V t_f\left(1 - \frac{\omega^2 t_f^2}{6}\right)$$

Displacement and orientation of the maneuvering target a projectile time of flight later relative to the V-A reference frame is $$[(\Delta x)^2+(\Delta y)^2]^{\frac{1}{2}}$$

and $$\psi = \tan^{-1}\frac{\Delta Y}{\Delta X}$$

Therefore, the orientation of the gun line offset relative to the orientation of the LOS to the maneuvering target is $$\lambda = \tan^{-1}\frac{(\Delta x^2 + \Delta y^2)^{\frac{1}{2}}\sin(\psi + \phi)}{R_p - (\Delta x^2 + \Delta y^2)^{\frac{1}{2}}\cos(\psi + \phi)},$$

and this provides the offset necessary to correct the gun sighting.

As mentioned above, in some cases, it is more convenient to use a truncated Taylor series version of the sine and cosine terms. This truncation leads to some inaccuracies. The applicants' calculations show, however, that the results obtained using only the first two terms of the Taylor series for $\Delta x$ and the first three terms for $\Delta y$ are reasonably good given the current state of the art.

Those skilled in the art will recognize, of course, that what has been described so far is a two dimensional system for determining proper aiming of a gun at a target which is not moving in a straight line. Obviously, such movement could extend to the third dimension as well. Several possible ways of dealing with this will be evident to those of skill in the art. One method is simply to treat acceleration in the third dimension, Z, as acceleration along the Y axis was treated. A second method involves assuming that a two-dimensional plane can be defined in space in which the arc of the target path is contained, thereby restricting target motion to be in this plane. Only if the target actually departs from this single plane during the projectile time of flight will the two-dimensional case not suffice. In either approach, the general principles of the invention, i.e. determination of an instantaneous arc of the maneuver, remains applicable.

Therefore, while a preferred embodiment of the invention has been disclosed, other modifications and improvements thereto can be expected to be made by those skilled in the art, and these are therefore deemed to be within its spirit and scope.

We claim:

1. A weapon fire control system comprising:

tracking means for generating a target tracking data signal at an output thereof;

estimating means connected to the output of the tracking means for filtering the tracking data signal and estimating its present velocity and acceleration effects;

predicting means having an input connected to the output of the estimating means for computing offset equations relating target present and future position;

the present position of the target being related to the future position of the target in accordance with the following offset equations, where the offsets are with respect to the target's present velocity and acceleration;

$T_f = T_p + \Delta x$ parallel to velocity $T_f = T_p + \Delta y$ parallel to acceleration where $T_f; T_p$ = target position-future and present $A_N$ = target acceleration normal to target velocity $V$ = target velocity $$\Delta x = \left[1 - \frac{\omega \Delta t_f^2}{6}\right] \cdot V \Delta t_f^2$$

$$\Delta y = \left[1 - \frac{\omega \Delta t_f^2}{12}\right] \cdot \tfrac{1}{2} A_N \Delta t_f^2$$

$\Delta t_f$ = projectile time-of-flight $A_N/V = \omega$ $\omega$ = cyclic frequency of maneuvering target; and means for calculating a gun line offset from a line-of-sight of the tracking means, as a function of the computed offsets, according to the following equation;

$$\lambda = \tan^{-1}\frac{(\Delta x^2 + \Delta y^2)^{\frac{1}{2}}\sin(\psi + \phi)}{R_p - (\Delta x^2 + \Delta y^2)^{\frac{1}{2}}\cos(\psi + \phi)}$$

where $$\psi = \tan^{-1}\frac{\Delta y}{\Delta x}$$

$$\phi = \tan^{-1}\frac{R_p\,\dot{\sigma}}{\dot{R}_p}$$

where $R_p$ = target present range $\dot{R}_p$ = target present range rate $\dot{\sigma}$ = target present line-of-sight rate; and gun line offset servo means responsive to the calculated gun line offsets for positioning a weapon in preparation for firing the weapon.

* * * * *

UNITED STATES PATENT AND TRADEMARK OFFICE

CERTIFICATE OF CORRECTION

PATENT NO. : 4,794,235

DATED : Dec 27, 1988

INVENTOR(S) : Harold H. Burke, et al.

It is certified that error appears in the above-identified patent and that said Letters Patent is hereby corrected as shown below:

In column 8, lines 22/24,

Replace: $\Delta x = [1 - \frac{\omega \Delta t_f^2}{6}] \bullet V\Delta t_f^2$

With: $\Delta x = [1 - \frac{\omega^2 \Delta t_f^2}{6}] \bullet V\Delta t_f$

In column 8, lines 25/26,

Replace: $\Delta y = [1 - \frac{\omega \Delta t_f^2}{12}] \bullet 1/2\ A_N \Delta t_f^2$ With: $\Delta y = [1 - \frac{\omega^2 \Delta t_f^2}{12}] \bullet 1/2\ A_N \Delta t_f^2$

Signed and Sealed this

Twelfth Day of May, 1992

*Attest:*

DOUGLAS B. COMER

*Attesting Officer*

*Acting Commissioner of Patents and Trademarks*